US008360346B2

(12) United States Patent
Furseth

(10) Patent No.: US 8,360,346 B2
(45) Date of Patent: Jan. 29, 2013

(54) BODYSPRAY ASSEMBLY

(75) Inventor: Michael R. Furseth, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 11/933,495

(22) Filed: Nov. 1, 2007

(65) Prior Publication Data

US 2009/0114739 A1 May 7, 2009

(51) Int. Cl.
*B05B 1/32* (2006.01)
*B05B 1/00* (2006.01)
*B05B 15/08* (2006.01)

(52) U.S. Cl. ..... 239/600; 239/451; 239/455; 239/587.1; 239/587.2; 239/587.4; 239/587.5

(58) Field of Classification Search ..... 239/243, 239/245, 451, 452, 455, 456, 457, 458, 460, 239/552, 554, 562, 587.1, 587.2, 587.3, 587.4, 239/587.5, 596, 600
See application file for complete search history.

(56) References Cited

U.S. PATENT DOCUMENTS

| | | | | |
|---|---|---|---|---|
| 2,302,366 | A * | 11/1942 | Bucknell et al. | 239/460 |
| 5,205,490 | A | 4/1993 | Steinhardt et al. | |
| 5,839,666 | A | 11/1998 | Heimann et al. | |
| 6,123,274 | A | 9/2000 | Perdreau et al. | |
| 6,659,372 | B2 * | 12/2003 | Marsh et al. | 239/560 |
| 6,739,527 | B1 * | 5/2004 | Chung | 239/558 |
| 7,004,410 | B2 * | 2/2006 | Li | 239/587.4 |
| D577,101 | S * | 9/2008 | Kong et al. | D23/213 |
| 7,455,247 | B2 * | 11/2008 | Kajuch | 239/451 |
| 2005/0184173 | A1 * | 8/2005 | Marty et al. | 239/587.4 |
| 2006/0196972 | A1 * | 9/2006 | Kajuch | 239/451 |
| 2008/0111007 | A1 * | 5/2008 | Grether | 239/428.5 |

FOREIGN PATENT DOCUMENTS

| | | |
|---|---|---|
| DE | 195 01 313 | 7/1996 |
| JP | 2004 251005 | 9/2004 |
| WO | WO-2006/093954 | 9/2006 |
| WO | WO 2006/093954 | 9/2006 |

OTHER PUBLICATIONS

Page from partial ISR on PCT/US2008/012003, dated Jan. 30, 2009, in a PCT application corresponding to the present application.
Page from ISR on PCT/US2008/012003, dated Mar. 19, 2009, in a PCT application corresponding to the present application.
Five pages of an EP communication dated Aug. 3, 2010, on a corresponding application.
Seven pages of an EP communication dated Aug. 5, 2010, on a corresponding application. This relates to a divisonal related to what was submitted to the Office earlier today.
Office Action on CN Application No. 200880114655.4, issue date Nov. 9, 2011, 11 pages.

* cited by examiner

*Primary Examiner* — Len Tran
*Assistant Examiner* — Ryan Reis
(74) *Attorney, Agent, or Firm* — Foley & Lardner LLP

(57) ABSTRACT

A bodyspray assembly is disclosed that provides a pivotable spray head mounted essentially flush with the surrounding enclosure wall. In one embodiment, a special tool is provided to rotate a waterway housing, to selectively couple the waterway housing to a source from the front of the assembly. In another embodiment, rotation of a spray face assembly rotates a waterway housing, to selectively couple the waterway housing to a source from the front of the assembly. The bodyspray assembly provides ball and socket type articulation.

14 Claims, 10 Drawing Sheets

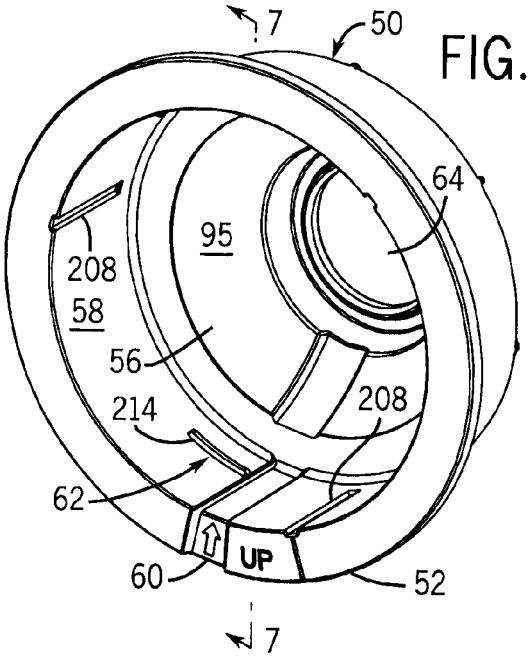
FIG. 6
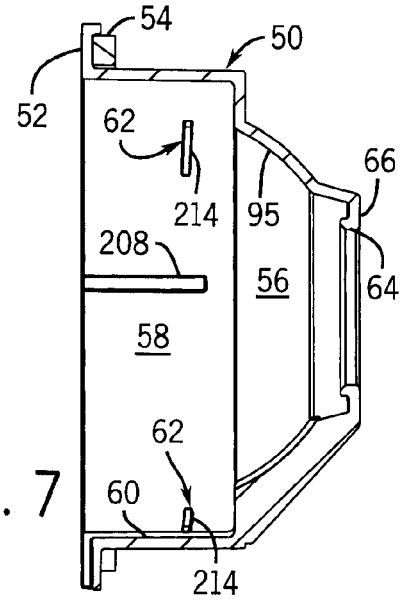
FIG. 7
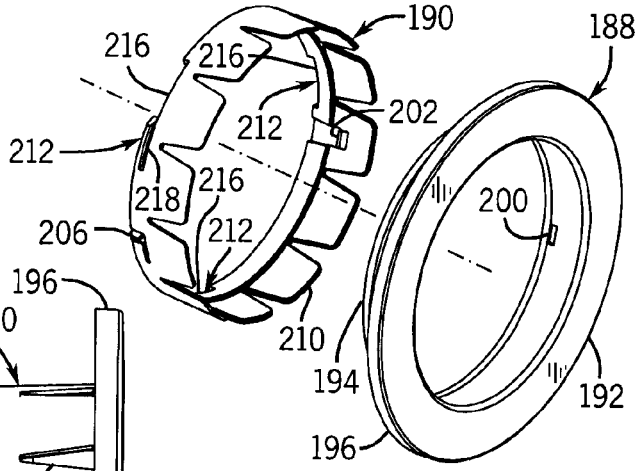
FIG. 8
FIG. 9
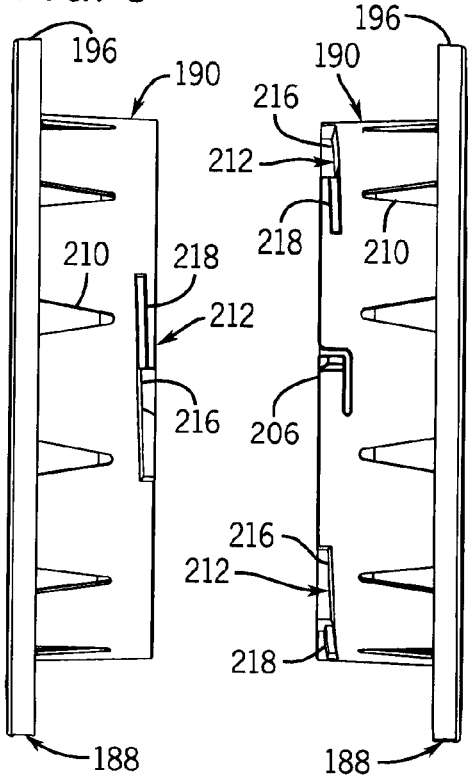
FIG. 10

BODYSPRAY ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to shower nozzle assemblies that are intended to direct water towards the torso of a person taking a shower. More particularly it relates to assemblies which are designed to reduce the need for access to the area behind the enclosure walls during installation and maintenance.

Traditional showers include a single showerhead extending from a water supply that is located near the top of the shower. The showerhead directs water downward onto the user.

Showers that are more elaborate sometimes also include one or more other nozzle assemblies mounted lower along an enclosure wall. This latter type of nozzle assembly is referred to by the term "bodyspray", as it is positioned to project water directly against the human torso, rather than down onto the human head or shoulders.

However, bodysprays should not project out very far from the walls they are mounted on as humans would bang into them. Further, it is ornamentally desirable to have such nozzle assemblies appear essentially flush with the enclosure wall. On the other hand, it is desirable to be able to aim the nozzle so as to optimize the direction of the spray to the portion of the body being hydromassaged by the water.

Hence, our company disclosed, in U.S. patent application publication 2006/0196972, a bodyspray that appears almost as if it were a wall tile (as being essentially flush with the wall), yet allows the direction of the nozzle to be aimed by a shower user in a simple and intuitive manner. While this unit has many beneficial attributes, it is desired to simplify the construction of its internal parts (and thus reduce cost), as well as to simplify installation and maintenance procedures for such a product.

Thus, a need exists for improved bodyspray constructions.

SUMMARY OF THE INVENTION

In one aspect the present invention provides a spray assembly mountable on a wall. The spray assembly is configured to receive supply water (typically mixed hot and cold water) from a source and emit the supply water as an adjustably directed spray.

The spray assembly has a rearward housing mountable adjacent the wall and defining an internal cavity, a waterway assembly housed in the rearward housing and having a waterway housing having an inlet coupleable to the source, a spray face assembly removably coupled to the waterway assembly, and a tool configured to engage the waterway housing while at least partially positioned in front of the waterway housing, and then rotate the waterway assembly to affect the tightness of a connection between the waterway assembly and the source when the waterway assembly is coupled to the source.

In preferred forms there is at least one radial undulation on a radial periphery of the waterway housing, such as an array of radially extending teeth on the radial periphery of the waterway housing. The tool may have an array of axially extending teeth so that the tool's teeth can intermesh and rotationally drive the waterway housing's teeth.

The spray assembly may be a bodyspray assembly where the waterway assembly also has a coupler extending into the inlet and defining an internal bore, and an adaptor having a downstream end configured to fit into the bore and an upstream end coupleable to the source. In this form rotation of the waterway housing by the tool causes rotation of the coupler about the adaptor, facilitating mounting of the waterway housing from the front of the installation.

This may be further assisted by a tool that has an axially extending handle and a body suitable to circumferentially surround (e.g. enclose) a frontal, pivotable portion of the spray assembly.

In another aspect the invention provides another type of spray assembly mountable on a wall and configured to receive supply water from a source and emit supply water as a directed spray. It has a waterway assembly including a waterway housing having an upstream end coupleable to the source, an internal passage, and a pivot ball. There is also a front framing escutcheon mountable along a front surface of the wall, a rearward housing mountable behind the front framing escutcheon and housing the waterway housing, and a spray face assembly pivotably mounted on the pivot ball so as to be able to tilt from a position essentially parallel to the wall within the front framing escutcheon to a variety of other positions.

In preferred forms the spray face assembly has a waterway plate positioned in front of the pivot ball and threadably connected thereto, and a through passage extending through the pivot ball and then through the waterway plate. The pivot ball is biased by a spring, there is a support ring between the pivot ball and the spring, there is a seal between the pivot ball and the waterway plate, and the framing escutcheon is connected to the rearward housing by a slot-and-groove connection implemented upon rotation of the framing escutcheon relative to the rearward housing. The framing escutcheon may be connected to the rearward housing by a bayonet engagement.

In a further aspect, the present invention provides a spray assembly mountable on a wall configured to receive supply water from a source and emit the supply water as an adjustably directed spray. It has a rearward housing mountable adjacent the wall and defining an internal cavity. A waterway assembly housed in the rearward housing includes a waterway housing having an inlet coupleable to the source and at least a first protrusion extending from the waterway housing. A spray face assembly removably coupled to the waterway assembly and having at least a second protrusion extending from the spray face assembly. The first protrusion and the second protrusion are configured to engage during rotation of the spray face assembly to affect the tightness of a connection between the waterway assembly and the source when the waterway assembly is coupled to the source.

In preferred forms the waterway assembly also has a coupler extending into the inlet and defining an internal bore, and an adaptor having a downstream end configured to fit into the bore and an upstream end coupleable to the source. In this form rotation of the spray face assembly causes rotation of the coupler about the adaptor, facilitating mounting of the waterway housing from the front of the installation. In further preferred forms, the first and second protrusions comprise first and second tabs that are configured to engage during rotation of the spray face assembly.

It will be appreciated that these assemblies simplify installation and maintenance by permitting more to be achieved from the front of the assembly. Further, this enables the front spray head to be tilted with essentially universal motion while keeping the costs of creating such a connection low.

These and still other advantages of the present invention will be apparent from the detailed description and drawings. What follows is merely a preferred embodiment of the present invention. To assess the full scope of the invention the claims should be looked to.

BRIEF DESCRIPTION OF THE DRAWINGS

FIG. 6 is a frontal, upper, right perspective view showing a housing portion of the bodyspray assembly;

FIG. 7 is a sectional view taken along line 7-7 of FIG. 6;

FIG. 8 is a frontal, upper, left perspective view of two parts of the framing escutcheon assembly of the bodyspray;

FIG. 9 is a right side elevational view of the framing escutcheon assembly, in assembled form;

FIG. 10 is a left side elevational view of the framing escutcheon assembly, in assembled form;

DETAILED DESCRIPTION OF THE PREFERRED EMBODIMENTS

Figure 1:
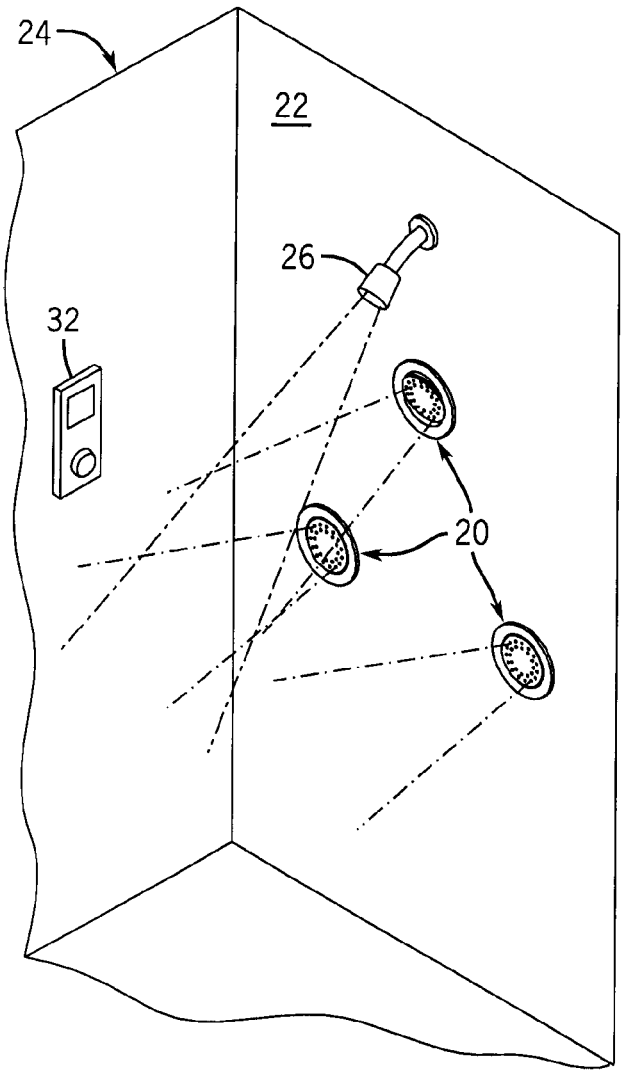
FIG. 1 is a frontal, upper, right perspective view showing bodyspray assemblies of the present invention installed in a shower enclosure.

First with reference to FIG. 1, three bodyspray assemblies 20 are shown mounted through a vertical enclosure wall 22 of shower enclosure 24. There is also a traditional showerhead 26 under the temperature, volume, and pattern control of an electrical controller 32. Alternatively, the flow and temperature of the water for each bodyspray or shower head could be controlled through conventional manual mixing valve(s).

The particular shape of the plate face 120 in front view is not critical, albeit we prefer the aesthetics of a round or square design. Further, we prefer to have the construction be installed essentially flush with the surrounding enclosure surface.

Figure 2:
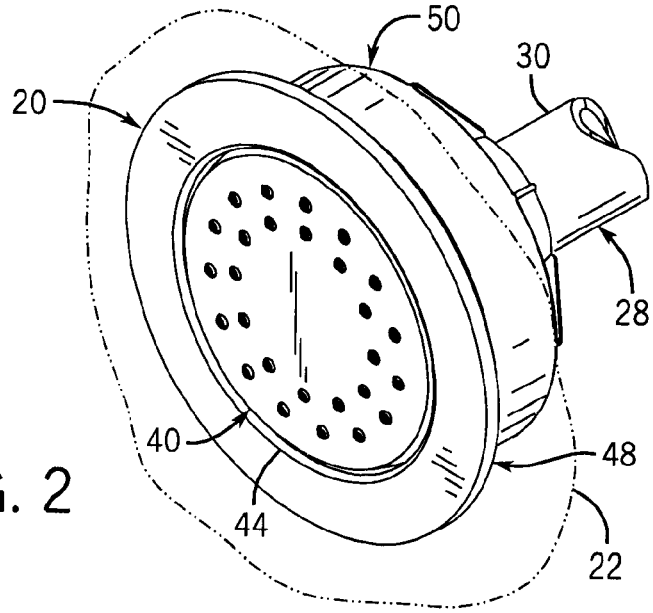
FIG. 2 is an enlarged frontal, upper, right perspective view showing a bodyspray assembly of the present invention coupled to a source for receiving supply water.
Figure 3:
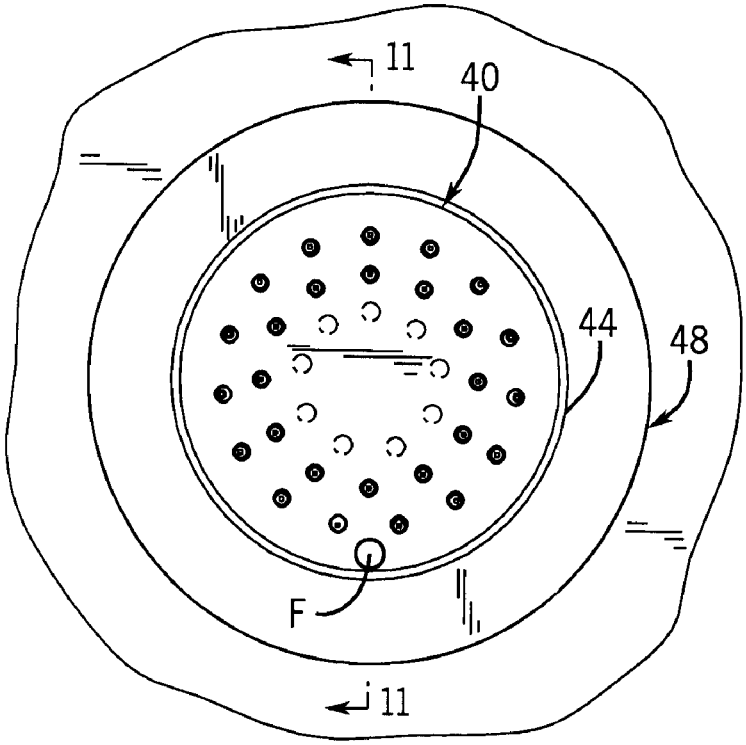
FIG. 3 is a front elevational view focusing on a bodyspray assembly of the present invention mounted through an enclosure wall.
Figure 4:
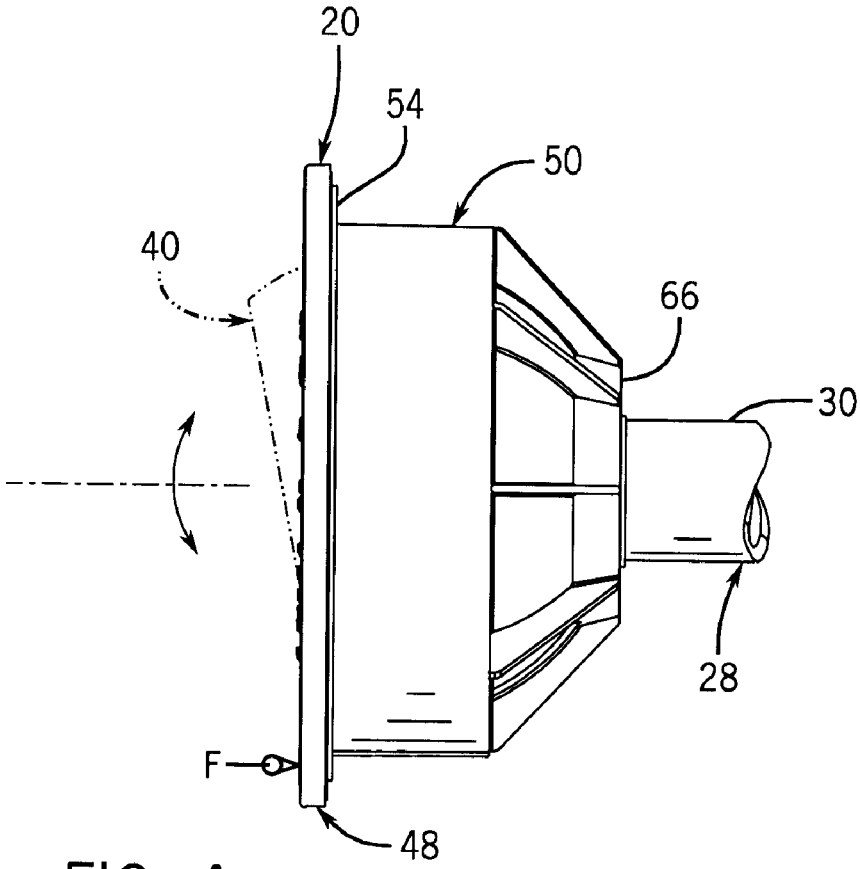
FIG. 4 is a right side elevational view of the FIG. 3 bodyspray assembly, with an alternative positioning of the spray face shown in dotted lines.

Turning next to FIG. 2, the bodyspray assembly 20 is coupled to a water source 28 through the wall 22 via supply pipe 30 linked to a mixing valve (not shown). The mixing valve is in turn controlled by controller 32.

Figure 11:
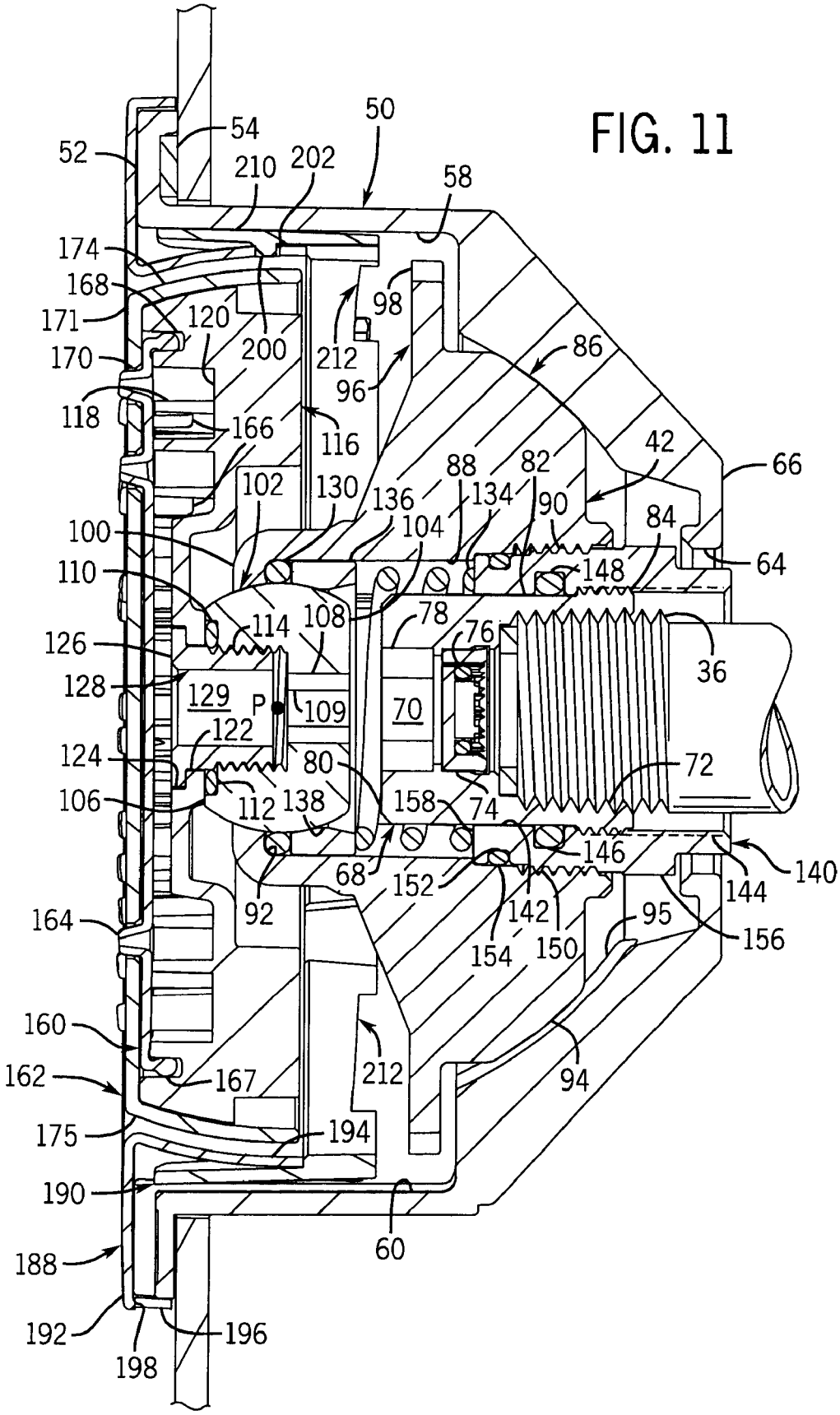
FIG. 11 is a sectional view taken along line 11-11 of FIG. 3.
Figure 12:
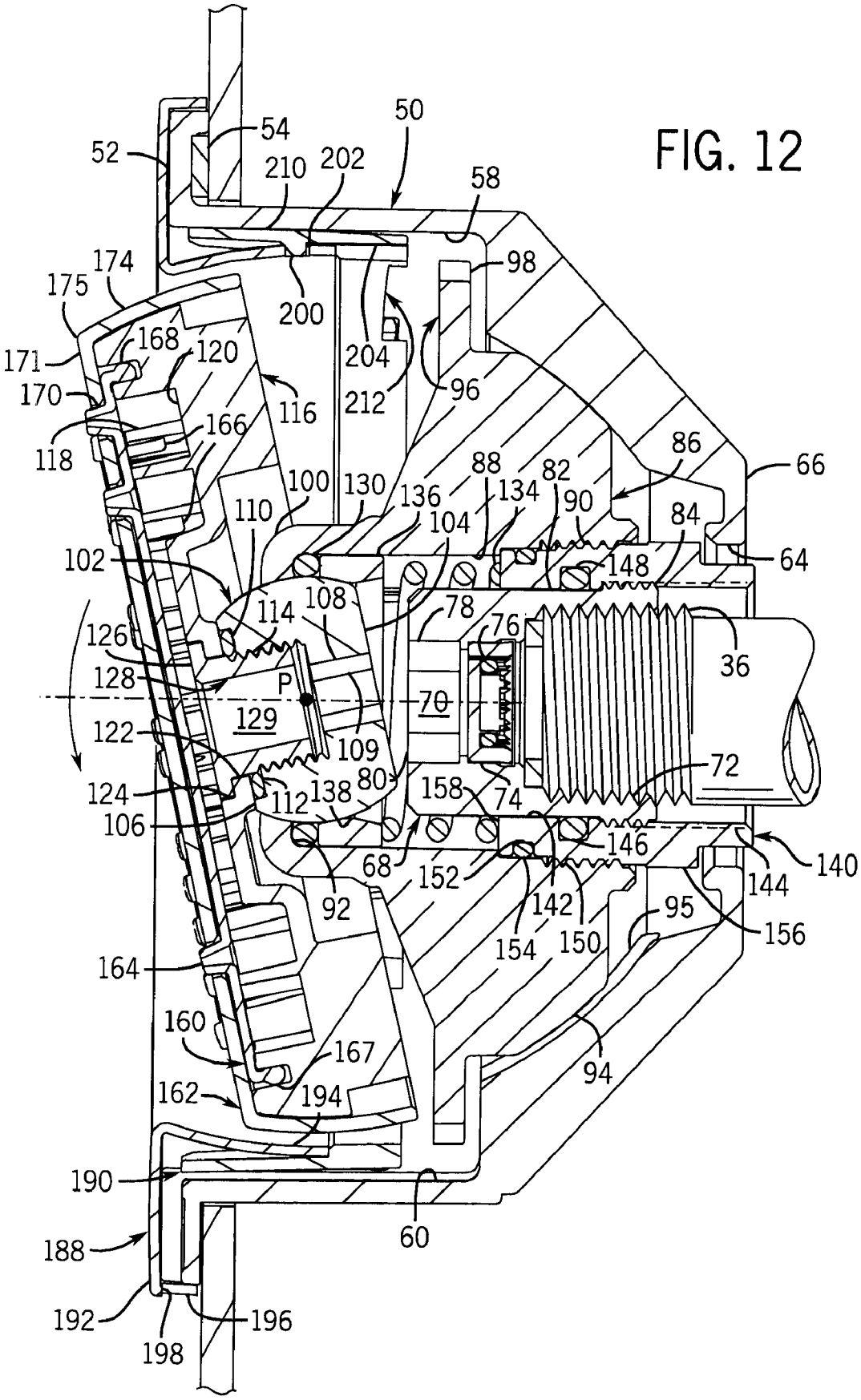
FIG. 12 is a view similar to FIG. 11, but showing the spray face assembly in an alternative orientation, to direct spray in a different direction.

As shown in FIG. 11, pipe 30 terminates in a threaded pipe nipple 36. A portion of the bodyspray assembly 20 is coupled to the nipple 36.

With particular reference to FIGS. 3, 4, 11 and 12, bodyspray assembly 20 includes a spray face assembly 40 that pivots essentially universally with respect to the waterway assembly 42 about point P. A user of the shower can press the plate face 120 near its radial periphery 44, which results in a tilting.

The bodyspray assembly 20 has three main subassemblies, a waterway assembly 46, a spray face assembly 40, and a frontal framing escutcheon assembly 48. There is also a rearward housing 50. The rearward housing 50 is inserted through an opening in the shower enclosure wall 22 so that its frontal flange is forward of the vertical wall 22, but most of its body extends rearward of the vertical wall.

With additional reference to FIGS. 6 and 7, it can be seen that the rearward housing 50 includes an annular flange 52 that sandwiches a gasket 54 between the flange 52 and the vertical wall 22 of the shower enclosure 24. The rearward housing 50 further defines an internal cavity 56 having an interior surface 58. The cavity 56 is sized to accommodate the waterway assembly 46.

The rearward housing 50 acts as a leak shield preventing water from leaking to the back side of the shower enclosure 24. A radially extending groove 60 formed in the rearward housing 50 is positioned downwardly and acts to further channel water within the housing 50 to the inside of the shower enclosure 24.

The interior surface 58 of the rearward housing 50 preferably includes three ribs 62 that are configured to catch into corresponding slots of the framing escutcheon assembly 48 upon rotation of the framing escutcheon assembly 48 relative to the rearward housing 50.

A central opening 64 is formed in the rear face 66 of the rearward housing 50 to allow the supply nipple 36 to extend at least partially into the cavity 56 of the rearward housing 50. An adaptor 68 is coupled to the nipple 36 and will ultimately result in the waterway assembly 46 and the water source 28 being in fluid communication.

The adaptor 68 has an internal bore 70 with an upstream end having internal threads 72 configured to engage the nipple 36. The downstream end of the bore 70 houses a flow regulator 74 and o-ring 76 (shown in FIG. 11) to limit the flow of water into the waterway assembly 46. The downstream end of the bore 70 terminates in a hexagonal bore 78 so that a mating hexagonal rod (not shown) can be inserted into the hexagonal bore 78 and used to tighten the adaptor 68 to the nipple 36. The exterior surface 82 of the adaptor 68 includes external threads 84 proximate the upstream end. The external threads 84 ultimately couple the adaptor 68 to the waterway assembly 46, as will be described in more detail below.

With the rearward housing 50 mounted to the vertical wall 22, the threaded pipe nipple 36 extending into the cavity 56, and the adaptor 68 secured to the pipe nipple 36, the waterway assembly 46 is pre-assembled and then inserted into the cavity 56 where it is then coupled to the water source 28.

The waterway assembly 46 includes a waterway housing 86 that directs water from the adaptor 68 to the spray face assembly 40. The waterway housing 86 includes an internal passage 88 that has internal threads 90 at an upstream end and defines a socket 92 at a downstream end. The waterway housing 86 has a frusto-spherical end 94 adjacent an annular flange 96 that is configured to engage a mating frusto-spherical surface 95 of the rearward housing 50 as the waterway housing 86 is tightened (shown in FIG. 13).

The annular flange 96 includes at least one undulation, such as a plurality of spaced gear-like teeth 98 that extend radially from the flange 96. A tightening tool 38 engages the gear teeth 98 to drive the waterway housing 86.

The socket 92 includes a lip 100 sized to axially restrain a pivot ball 102 in the internal passage 88. The pivot ball 102 is used to couple the spray face assembly 40 to the waterway assembly 46. The pivot ball 102 includes an upstream face 104 and a downstream face 106 with a partially threaded hole 108 extending between the upstream face 104 and the downstream face 106. The downstream face 106 includes a recess 110 for locating a seal 112, such as an o-ring or a flexible washer.

The hole 108 includes internal threads 114 extending from the recess 110 to approximately halfway between the downstream face 106 and the upstream face 104. The balance of the hole 108 defines a hexagonal cavity 109 for engaging a hexagonal rod (not shown) to allow tightening of the pivot ball 102 to the spray face assembly 40. The pivot ball 102 is preferably machined from brass, but may be produced from any other suitable material, such as steel or a variety of plastics.

Turning next to the spray face assembly 40, there is a waterway plate 116 that is a disk-shaped plate having a plurality of c-shaped, center opening column diverters 118 arranged in radially expanding concentric circles from the downstream plate face 120. A variety of diverter 118 combinations are available, for example, with additional reference to FIG. 3, an inner ring of diverters 118 may be included.

The waterway plate 116 includes a central hole 122 having a recessed hexagonal cavity 124 configured to capture the hexagonal head 126 of a waterway plate retainer 128. The cavity 124 and head 126 may alternatively be of any other keyed construction such that seating the head 126 into the cavity 124 results in the waterway plate 116 and the waterway plate retainer 128 rotating in unison; however, the engagement need not be keyed.

The waterway plate retainer 128 includes a passage 129 formed preferably centrally there through. The passage 129 allows the internal passage 88 of the waterway housing 86 to be in fluid communication with the downstream side of the waterway plate 116, yet secures the waterway plate 116 to the pivot ball 102.

The waterway plate 116 is captured between the waterway plate retainer 128 and the pivot ball 102. A seal 130, for example an o-ring or flexible washer, is placed into the internal passage 88 and abuts the lip 100. The pivot ball 102 is slid into the internal passage 88 of the housing 86 so that the downstream face 106 of the pivot ball 102 is exposed on the downstream side of the housing 86.

An additional seal 112 is seated in the recess 110 formed in the downstream face 106 of the pivot ball 102. The hole 122 in the waterway plate 116 is aligned with the hole 108 in the pivot ball 102. The waterway plate retainer 128 is tightened into the threaded hole 108 formed in the pivot ball 102. To fully secure the waterway plate 116, a hexagonal rod (not shown) is inserted into the hexagonal cavity 109 of the pivot ball 102, so that the waterway plate 116 and waterway plate retainer 128 can be rotated relative to the pivot ball 102. The head 126 of the waterway plate retainer 128 engages the mating cavity 124 in the waterway plate 116, such that rotation of the waterway plate 116 causes rotation of the waterway plate retainer 128. The waterway plate 116 is thus captured to the housing 86 via the waterway plate retainer 128.

The pivot ball 102 is resiliently mounted in the internal passage 88 by a coil spring 134. A preferably plastic support ring 136 having an internal ridge 138 is axially aligned with the internal passage 88 and seated adjacent the pivot ball 102. The spring 134 is axially aligned and placed into the internal passage 88 where it abuts the support ring 136. The support ring 136 and spring 134 are captured in the internal passage 88 by a coupler 140. The coupler 140 connects the waterway assembly 46 and attached spray face assembly 40 to the adaptor 68, and thus the water source 28.

The coupler 140 includes an internal bore 142 having internal threads 144 for engaging the adaptor 68. The internal threads 144 extend from an upstream end and terminate at an internal recess 146 that houses an internal seal 148. External threads 150 extend from an external recess 152 housing an external seal 154 to a hexagonal flange 156 for engaging a tool (e.g., a wrench). A bearing face 158 located on the downstream end of the coupler 140 abuts the spring 134 causing the spring 134 to compress as the external threads 150 of the coupler 140 are threaded into the internal threads 90 formed in the housing 86. The coupler 140 of the example embodiment is machined from brass, but as with the other components, may be made from any suitable metal or plastic material depending upon the application requirements.

The spray face assembly 40 also includes a nozzle panel 160 and a faceplate 162. The nozzle panel 160 is secured to the waterway plate 116 and establishes a directed spray. The nozzle panel 160 of the example embodiment is a circular mat including a plurality of nozzles 164 extending from the downstream side. The nozzles 164 are substantially aligned with the central axis of the diverters 118 and the upstream side of the nozzle panel 160 includes several alignment tabs 166 that are configured to extend into the array of diverters 118 when the nozzle panel 160 engages the waterway plate 116.

An annular bead 167 extends from the upstream side of the nozzle panel 160 about the periphery and is configured to slightly compress as it is wedged into an annular channel 168 formed in the periphery of the waterway plate 116. The nozzle panel 160 is preferably molded of a resilient, flexible rubber or plastic material; however, the nozzle panel 160 may be made from a rigid plastic or metallic material.

Figure 5:
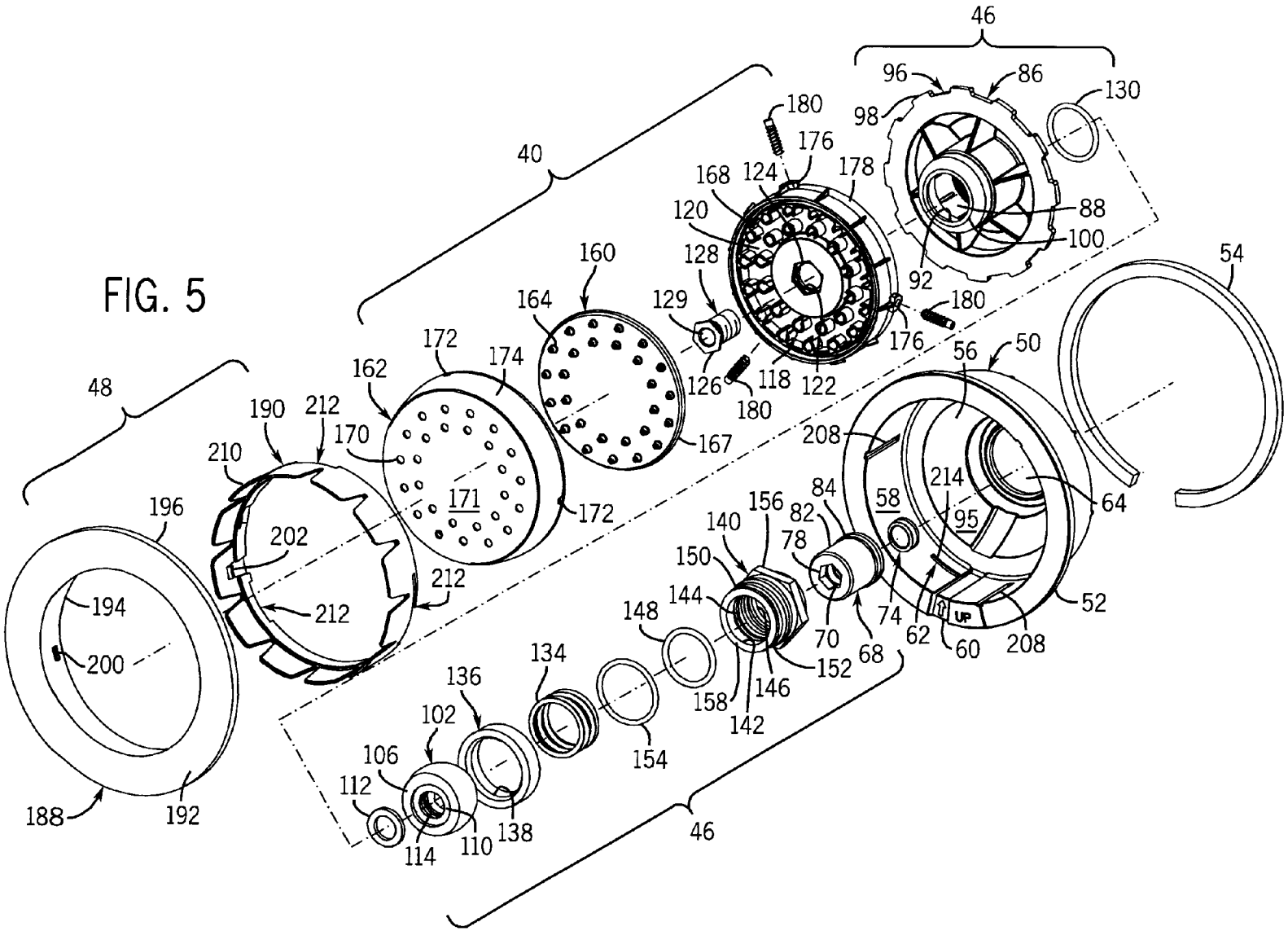
FIG. 5 is an exploded perspective view of the bodyspray assembly.

As indicated by FIGS. 5 and 11, after the nozzle panel 160 is secured, apertures 170 formed on the downstream face 171 of the dish-shaped faceplate 162 are aligned with the nozzles 164 and slid over the nozzle panel 160 and onto the waterway plate 116. The nozzles 164 preferably extend beyond the downstream side of the faceplate 162. The faceplate 162 has three holes 172 through an annular rim 174. To secure the faceplate 162 to the waterway plate 116, the holes 172 are aligned with mating threaded mounts 176 formed in the annular surface 178 of the waterway plate 116.

A fastener 180, such as a set screw, is inserted into the mount 176 through the hole 172 to secure the faceplate 162 to the waterway plate 116. The faceplate 162 is preferably made of steel and subsequently plated with another metal, such as nickel or chromium. The faceplate 162 may alternatively be made of plastic, plated plastic, and the like.

Note especially that the waterway assembly 46 and spray face assembly 40 are coupled to the water source 28 with the aid of the tightening tool 38. The combination of the small size of the gap 182 between the exterior surface 175 of the spray face assembly 40 and the rearward housing 50, and the ability of the spray face assembly 40 to pivot, makes it difficult to tighten the waterway assembly 46 to the nipple 36 in conventional ways. The tool 38 (shown in FIG. 14) is used to directly tighten the waterway assembly 46 to the nipple 36 despite the narrowness of the gap 182 and pivoting of the spray face assembly 40.

The tool 38 is substantially cup-shaped and includes a keyed undulation (e.g., keyed teeth 184) that match up with the undulation (e.g., teeth 98) formed by the waterway housing 86. In the example embodiment, the teeth 98 that extend from the flange 96 of the housing 86 are engaged by the keyed teeth 184 that are formed in the tool 38.

In operation, the spray face assembly 40 is slid into a central cavity 186. One then allows the keyed teeth 184 of the tool 38 to mate with and engage the teeth 98 of the waterway housing 86. The tool 38 includes a handle 39 protruding forward from the exterior surface 41 of the tool 38, allowing leverage for rotational force to drive the waterway assembly 46.

It is contemplated that the undulations formed in the waterway housing 86 and the mating undulations formed in the tool 38 can take on a variety of different constructions that all result in the ability to impart a rotational force on the waterway housing 86 via the tool 38 (e.g. peg and hole). Therefore, the specific structure described in relation to the example embodiment (i.e., teeth 98 and mating keyed teeth 184) should not limit the broadest scope of the claims.

Figures 13, 14:
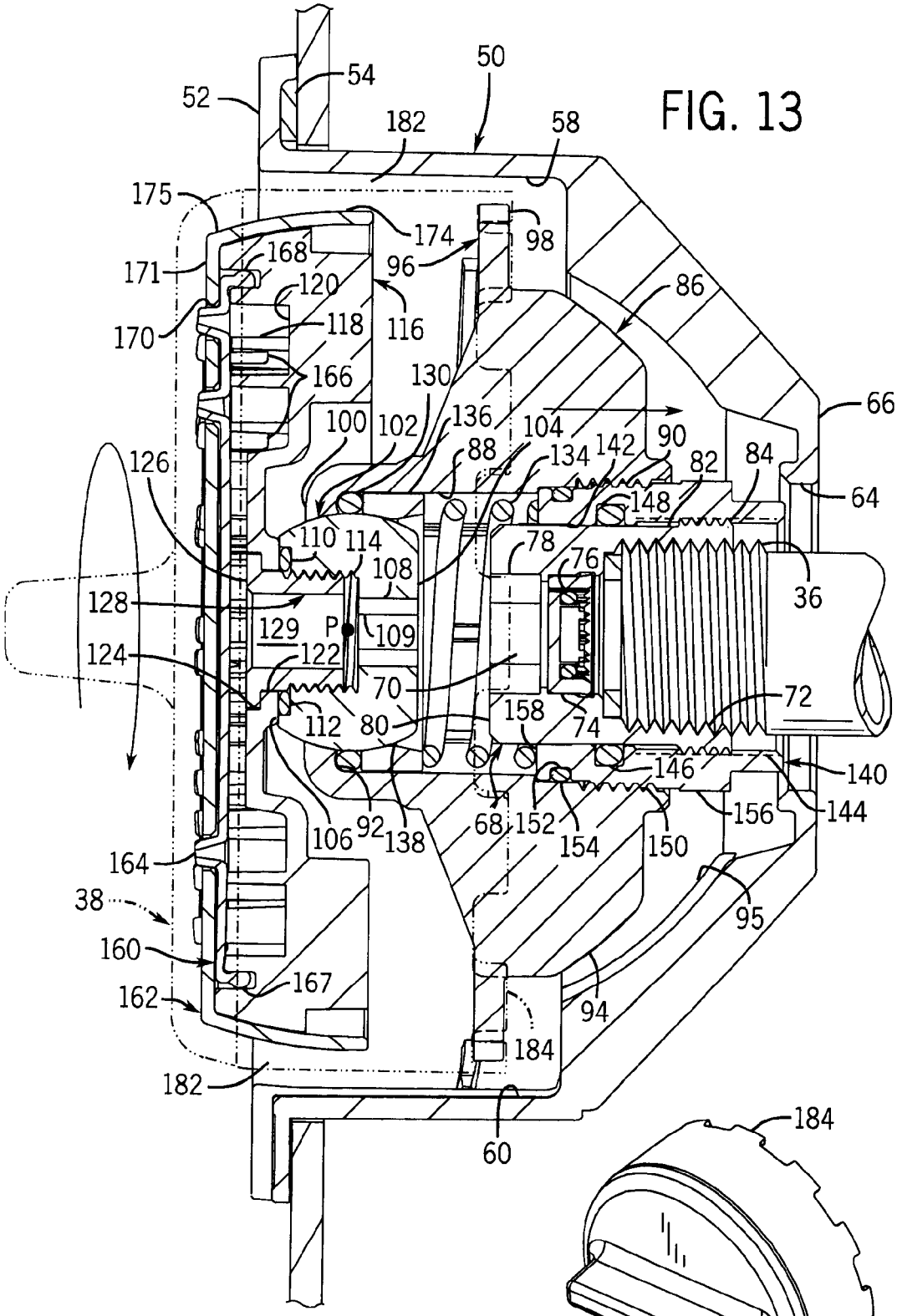
FIG. 13 is a view similar to FIG. 11, but showing how a tool can be inserted to facilitate installation.
FIG. 14 is a frontal, upper, right perspective view showing the FIG. 13 tool by itself.

With specific reference to FIG. 13, the bodyspray assembly 20 is placed into fluid communication with the water source 28 by inserting the downstream end of the adaptor 68 into the upstream end of the coupler 140, such that the external threads 84 of the adaptor 68 engage the internal threads 144 of the coupler 140. The tool 38 is then used to engage the waterway housing 86 and rotate the waterway housing 86, and thus the coupler 140, about the adaptor 68.

The escutcheon assembly 48 is secured to the housing 50 to provide a finished appearance to the bodyspray assembly 20. The escutcheon assembly 48 includes a collar 188 and a sleeve 190 that are rotatably coupleable to the housing 50 via a series of interlocking surfaces. The collar 188 includes a front face 192 and a flared flange 194 extending from the front face 192. The front face 192 further includes a lip 196 having a notch 198 that is ultimately aligned with the groove 60 in the rearward housing 50, allowing water to easily drain out of the rearward housing 50.

The sleeve 190 is clipped to the collar 188 by aligning a series of annularly spaced holes 200 formed in the flange 194 with a mating series of annularly spaced wedges 202 located on the interior surface 204 of the sleeve 190. The sleeve 190 further includes a resilient positioning tab 206 biased outwards such that as it rides along the interior surface 58 of the rearward housing 50, it rebounds into a slot 208 formed on the interior surface 58 to limit the rotation of the sleeve 190 within the rearward housing 50. The sleeve 190 includes a series of wedge shaped fingers 210 that flex slightly when the sleeve 190 is inserted into the housing 50, helping to stabilize the sleeve 190 and collar 188 in the rearward housing 50. It is of note that the sleeve 190 (and the attributes thereof) may be integral with the collar 188, such that the structure of the collar 188 incorporates the features of the sleeve 190. The sleeve 190 is preferably made of plastic so it can be slightly deformed to engage the collar 188, however, the sleeve 190 may be made of any suitable material, including metal.

Coupling the escutcheon assembly 48 to the rearward housing 50 is preferably accomplished via a bayonet-style connection between ribs 62 found on the interior surface 58 of the rearward housing 50 (described in-part below) and a mating interlocking surface 212 formed in the sleeve 190. In the example embodiment, the ribs 62 of the rearward housing 50 include a rectangular protrusion 214. The mating interlocking surface 212 of the sleeve 190 includes a notch 216 leading to an angled channel 218. Thus, to secure the escutcheon assembly 48 to the rearward housing 50, the notch 216 of the sleeve 190 is aligned with the protrusion 214 of the rearward housing 50.

The example embodiment includes a total of three notches 216 and three protrusions 214 equally spaced about the periphery of the rearward housing 50 and sleeve 190. Rotating the escutcheon assembly 48 clockwise (as viewed from the face of the bodyspray assembly 20) results in the ribs 62 and mating interlocking surface 212 engaging and camming against the other to draw the escutcheon assembly 48 nearer to the annular flange 52 of the housing. Alternatively, the protrusion may be formed on the escutcheon assembly 48 and the notch formed in the rearward housing 50.

Figure 15:
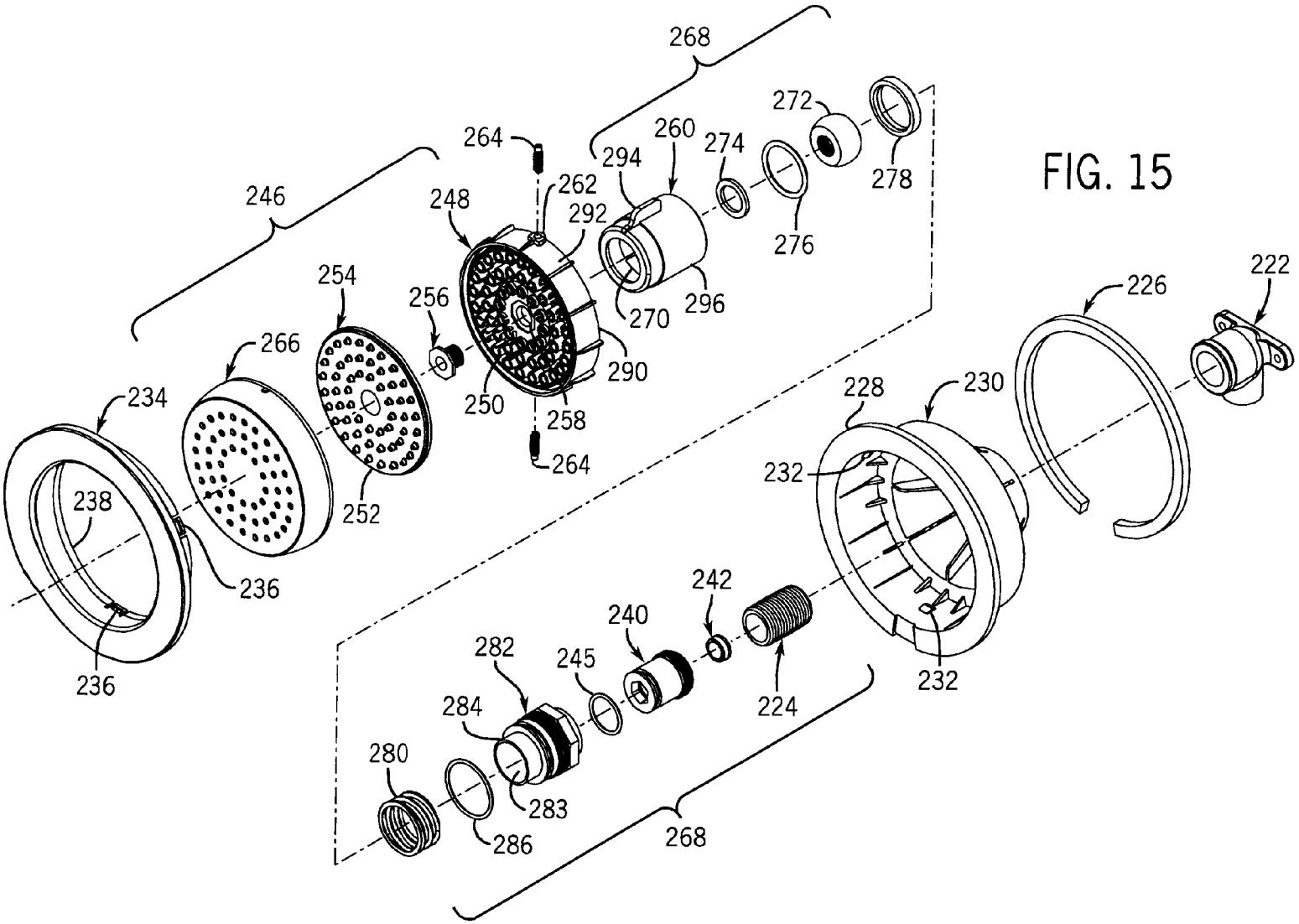
FIG. 15 is an exploded perspective view of an alternative bodyspray assembly.
Figure 16:
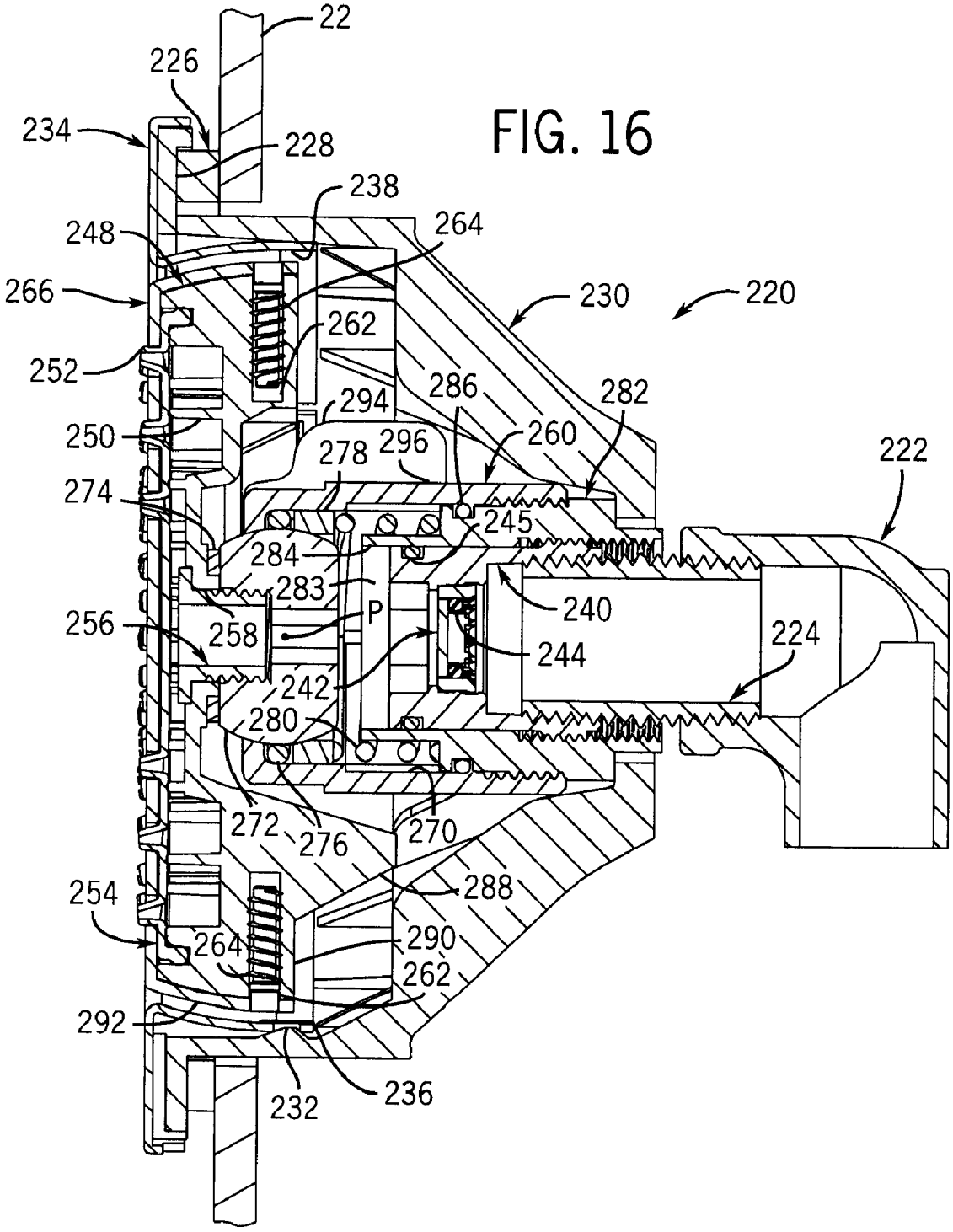
FIG. 16 is a sectional view similar to FIG. 11, but showing the alternative bodyspray assembly.
Figure 17:
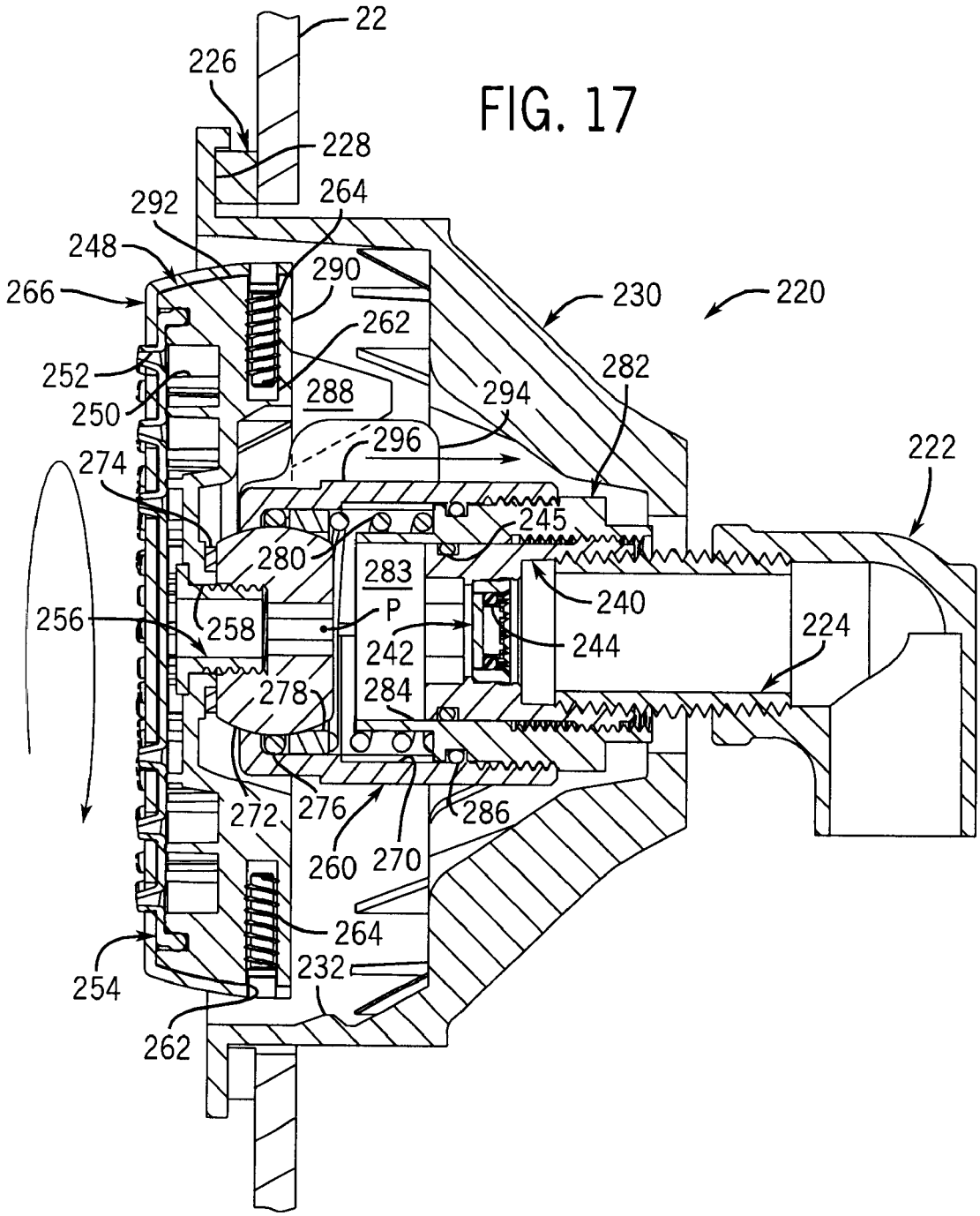
FIG. 17 is a view similar to FIG. 16, but showing how rotation of the spray face assembly facilitates installation.

An alternative bodyspray assembly 220 is shown in FIGS. 15-17. The alternative bodyspray assembly 220 is substantially similar in construction to the bodyspray assembly 20; the main variations are discussed below.

An elbow 222 is secured to the mounting studs (not shown) and coupled to the water source 28. A threaded nipple 224 is threaded into the elbow 222 such that a portion of the nipple 224 protrudes from the elbow 222. A gasket 226 is sandwiched between the wall 22 and a flange 228 of a rearward housing 230.

The rearward housing 230 includes a series of annularly spaced ramps 232 that are used to couple an escutcheon 234 to the rearward housing 230. The escutcheon 234 has flexible tabs 236 that are annularly spaced about a collar 238 of the escutcheon 234 such that the tabs 236 flex as they cam up the ramps 232 and rebound to the original position at the backside of the ramps 232 to releasably secure the escutcheon 234 to the rearward housing 230. An adaptor 240, including a flow regulator 242, an o-ring 244, and a seal 245 is threaded onto the nipple 224 at an upstream end 225, similar to the first embodiment described.

The spray face assembly 246 includes an alternative waterway plate 248 having three concentric rings of diverters 250 that match up with three rings of nozzles 252 on the adjacent nozzle panel 254. A waterway plate retainer 256 extends through a hole 258 in the waterway plate 248 to capture a waterway housing 260 (described below). Note that the waterway plate 248 includes a pair of mounts 262 for receiving a pair of fasteners 264 that secure a faceplate 266 to the waterway plate 248.

A waterway assembly 268 includes the waterway housing 260 having an internal passage 270 housing a pivot ball 272, seal 274, o-ring 276, support ring 278, and spring 280 (best shown in FIG. 16). A coupler 282 including an internal bore 283 has a collar 284 that extends into the center of the spring 280 and includes an o-ring 286.

The waterway plate 248 is captured between the waterway plate retainer 256 and the pivot ball 272, similar to that described above. The coupler 282 secures the remaining components in the internal passage 270.

The waterway plate 248 and the waterway housing 260 provide an alternative structure to tighten the waterway assembly 268 to the water source 28 without the use of the external tool 38.

The waterway plate 248 includes at least one protrusion or tab 288 that extends rearward from the back face 290 of the waterway plate 248 (shown in FIGS. 16 and 17). Multiple tabs 288 can be included to extend from the back face 290 or perimeter 292 of the waterway plate 248. The tab 288 may be integral with the waterway plate 248 or an additional component coupled thereto.

The waterway housing 260 includes at least one mating protrusion or tab 294 extending radially outward from the main body 296 of the waterway housing 260. As with the waterway plate 248, the waterway housing 260 may include a plurality of tabs 294 extending therefrom. Again, the tab 294 may be integral or coupled to the waterway housing 260.

With specific reference to FIG. 17, the tab 288 extending from the waterway plate 248 is sized such that as the waterway plate 248 rotates with the pivot ball 272 it will interfere with and engage the tab 294 extending from the waterway housing 260. The engagement between the tab 294 of the waterway housing 260 and the tab 288 of the waterway plate 248 will cause the waterway housing 260 and coupler 282 to rotate about the adaptor 240. Thus, no additional tool is required to couple the waterway housing 260 to the water source 28 and both the directional adjustment of the spray face assembly 246 and sleek ornamental look of the bodyspray assembly 220 are maintained.

The waterway plate 248 preferably includes a single tab 288 that engages a single tab 294 of the waterway housing 260 so typical rotation and pivoting of the spray face assembly 246 will not cause the user to inadvertently loosen the coupler 282 from the nipple 224. However, multiple protrusions may be used, for example, where more drive is required to thread the coupler 282 to the adaptor 240.

The above configurations make removal and repair of the bodyspray assembly 20 from the front a relatively easy task that allows the mounting surface to remain intact and an overall finished appearance is maintained. Further, reinstallation can be achieved from the front.

A preferred example embodiment of the present invention has been described in considerable detail. Many modifications and variations of the preferred example embodiment described will be apparent to a person of ordinary skill in the art. Therefore, the invention should not be limited to the example embodiment described.

INDUSTRIAL APPLICABILITY

The invention provides spray assemblies for use in shower enclosures, particularly where the assemblies can more easily installed and maintained.

I claim:

1. A spray assembly mountable on a wall, the spray assembly being configured to receive supply water from a source and emit supply water as a directed spray, the spray assembly comprising:

a rearward housing mountable adjacent the wall and defining an internal cavity;

a waterway assembly housed by the rearward housing and having a waterway housing having an inlet coupleable to the source;

a spray face assembly removably coupled to the waterway assembly; and a tool configured to engage the waterway housing while at least partially positioned in front of the spray face assembly, and then rotate the waterway housing to effect tightness of a connection between the waterway assembly and the source if the waterway assembly is coupled to the source;

wherein the waterway assembly further comprises:

a coupler extending into the inlet and defining an internal bore; and an adaptor having a downstream end configured to fit into the bore and an upstream end coupleable to the source;

wherein rotation of the waterway housing by the tool causes rotation of the coupler about the adaptor;

wherein the coupler is threadably engaged with the waterway housing and the adaptor.

2. The spray assembly of claim 1, wherein there is at least one undulation on a radial periphery of the waterway housing.

3. The spray assembly of claim 2, wherein there is an array of radially extending teeth on the radial periphery of the waterway housing, the tool has an array of axially extending teeth, and the teeth of the tool are configured to intermesh and be suitable to rotationally drive the waterway housing's teeth.

4. The spray assembly of claim 1, wherein the spray assembly is a bodyspray assembly.

5. The spray assembly of claim 1, wherein the tool further comprises an axially extending handle.

6. The spray assembly of claim 1, wherein the tool has a body suitable to circumferentially surround a frontal portion of the spray assembly that pivots on a separate axis from an axis that the tool can rotate on when so circumferentially positioned.

7. A spray assembly mounted on a wall, the spray assembly being configured to receive water from a source and emit water as a directed spray, the spray assembly comprising:

a waterway assembly including a waterway housing having an upstream end coupleable to the source, an internal passage, and a pivot ball provided at least partially in the internal passage;

a front framing escutcheon mounted along a front surface of the wall;

a rearward housing mounted behind the front framing escutcheon and housing the waterway housing; and a spray face assembly pivotably mounted on the pivot ball so that the spray face assembly may tilt relative to the front framing escutcheon from a position essentially parallel to the wall within the front framing escutcheon to a variety of other positions relative to the front framing escutcheon within the front framing escutcheon where it is not essentially parallel to the wall;

wherein when the spray face assembly is essentially parallel to the wall it is framed by the framing escutcheon and a front of the spray face assembly is then essentially flush with the wall;

wherein the pivot ball is biased toward a portion of the waterway housing by a spring; and wherein the framing escutcheon is connected to the rearward housing by a slot-and-groove connection implemented upon rotation of the framing escutcheon relative to the rearward housing.

8. The spray assembly of claim 7, wherein the spray face assembly has a waterway plate positioned in front of the pivot ball and threadably connected thereto.

9. The spray assembly of claim 8, wherein there is a through passage extending through the pivot ball and then through the waterway plate.

10. The spray assembly of claim 7, further comprising a support ring between the pivot ball and the spring.

11. The spray assembly of claim 10, wherein there is also a seal between the pivot ball and the waterway plate.

12. The spray assembly of claim 7, wherein the framing escutcheon is connected to the rearward housing by a bayonet engagement.

13. A spray assembly mountable on a wall, the spray assembly being configured to receive supply water from a source and emit supply water as a directed spray, the spray assembly comprising:

a rearward housing mountable adjacent the wall and defining an internal cavity;

a waterway assembly housed by the rearward housing and having a waterway housing having an inlet coupleable to the source and at least a first protrusion extending from the waterway housing; and a spray face assembly removably coupled to the waterway assembly and having at least a second protrusion extending from the spray face assembly, whereby by rotating the second protrusion relative to the first protrusion the protrusions can be caused to engage with each other;

wherein the at least first protrusion and the at least second protrusion are configured to engage due to such rotation of the spray face assembly to effect tightness of a connection between the waterway assembly and the source if the waterway assembly is coupled to the source;

wherein the waterway assembly further comprises:

a coupler extending into the inlet and defining an internal bore; and an adaptor having a downstream end configured to fit into the bore and an upstream end coupleable to the source;

wherein rotation of the spray face assembly causes rotation of the coupler about the adaptor; and wherein the coupler is threadably engaged with the waterway housing and the adaptor.

14. The spray assembly of claim 13, wherein the at least first protrusion comprises a first tab; and the at least second protrusion comprises a second tab; wherein the first tab and the second tab are configured to engage during rotation of the spray face assembly.

* * * * *